US007282989B2

(12) United States Patent
Byeon

(10) Patent No.: US 7,282,989 B2
(45) Date of Patent: Oct. 16, 2007

(54) INTERNAL VOLTAGE GENERATION CIRCUIT OF SEMICONDUCTOR DEVICE

(75) Inventor: Sang-Jin Byeon, Kyoungki-do (KR)

(73) Assignee: Hynix Semiconductor, Inc. (KR)

( * ) Notice: Subject to any disclaimer, the term of this patent is extended or adjusted under 35 U.S.C. 154(b) by 0 days.

(21) Appl. No.: 11/321,420

(22) Filed: Dec. 29, 2005

(65) Prior Publication Data

US 2007/0001753 A1 Jan. 4, 2007

(30) Foreign Application Priority Data

Jun. 30, 2005 (KR) ..... 10-2005-0058714

(51) Int. Cl.
*G05F 1/10* (2006.01)

(52) U.S. Cl. ..... 327/541

(58) Field of Classification Search ..... 327/535, 327/537, 538, 540, 541, 543
See application file for complete search history.

(56) References Cited

U.S. PATENT DOCUMENTS 5,929,696 A * 7/1999 Lim et al. ..... 327/540
5,942,933 A * 8/1999 Yang ..... 327/530
6,529,423 B1 3/2003 Yoon et al.
7,142,044 B2 * 11/2006 Sano ..... 327/540
2003/0174575 A1 9/2003 Kono

FOREIGN PATENT DOCUMENTS

| | | |
|---|---|---|
| JP | 8-18676 | 1/1996 |
| JP | 10-69770 | 3/1998 |
| JP | 2004-192791 | 7/2004 |
| KR | 1997-51105 | 7/1997 |
| KR | 10-2003-0097024 | 12/2003 |

* cited by examiner

*Primary Examiner*—Jeffrey Zweizig
(74) *Attorney, Agent, or Firm*—Blakeky Sokoloff Taylor & Zafman

(57) ABSTRACT

An internal voltage generation circuit of a semiconductor device includes: a comparator for comparing a reference voltage level with a detection voltage level to provide a comparison signal; an internal voltage output device for raising a voltage of an internal voltage output terminal to a predetermined level in response to the comparison signal; and an internal voltage output controller for controlling the internal voltage output terminal to be raised to a selected level. A voltage applied to the internal voltage output terminal is outputted as an internal voltage.

11 Claims, 5 Drawing Sheets

FIG. 3

<512M DDR SDRAM Mode Register Operation>

| BA1 | BA0 | A12 | A11 | A10 | A9 | A8 | A7 | A6 | A5 | A4 | A3 | A2 | A1 | A0 | Addres Bus |
|---|---|---|---|---|---|---|---|---|---|---|---|---|---|---|---|
| 0* | 0* | Operating Mode | | | | | | CAS Latency | | | BT | Burst Length | | | Mode Register |

| A12-A9 | A8 | A7 | A6-A0 | Operating Mode |
|---|---|---|---|---|
| 0 | 0 | 0 | Valid | Normal operation Do not reset DLL |
| 0 | 1 | 0 | Valid | Normal operation in DLL Reset |
| 0 | 0 | 1 | | Test Mode |
| - | - | - | | Reserved |

| A6 | A5 | A4 | Latency |
|---|---|---|---|
| 0 | 0 | 0 | Reserved |
| 0 | 0 | 1 | Reserved |
| 0 | 1 | 0 | 2 |
| 0 | 1 | 1 | 3 |
| 1 | 0 | 0 | Reserved |
| 1 | 0 | 1 | 1.5(optional) |
| 1 | 1 | 0 | 2.5 |
| 1 | 1 | 1 | Reserved |

| A2 | A1 | A0 | Burst Length |
|---|---|---|---|
| 0 | 0 | 0 | Reserved |
| 0 | 0 | 1 | 2 |
| 0 | 1 | 0 | 4 |
| 0 | 1 | 1 | 8 |
| 1 | 0 | 0 | Reserved |
| 1 | 0 | 1 | Reserved |
| 1 | 1 | 0 | Reserved |
| 1 | 1 | 1 | Reserved |

| A3 | Burst Type |
|---|---|
| 0 | Sequential |
| 1 | Inerleave |

INTERNAL VOLTAGE GENERATION CIRCUIT OF SEMICONDUCTOR DEVICE

FIELD OF THE INVENTION

The present invention relates to a semiconductor memory device; and more particularly, to internal power of a semiconductor memory device.

DESCRIPTION OF RELATED ART

In general, a semiconductor memory device includes an internal voltage generation circuit for supplying an internal power needed for an internal circuitry.

The internal voltage generation circuit receives a power voltage and a ground voltage applied from an external source, and generates and outputs the internal voltage required for the internal circuitry.

FIG. 1 is a circuit diagram setting forth a conventional semiconductor memory device. In particular, FIG. 1 is the circuit diagram illustrating an internal voltage generator for outputting an internal voltage.

Referring to FIG. 1, the conventional internal voltage generator of a semiconductor memory device includes a comparator 10 for comparing a level of a reference voltage VREF with a level of a detection voltage VD, and an internal voltage output unit 20 for outputting an internal voltage VINT corresponding to the comparison result of the comparator 10, and outputting the detection voltage VD corresponding to a level of the outputted internal voltage VINT.

The comparator 10 is provided with a diode-connected P-type metal oxide semiconductor (PMOS) transistor MP2 of which one side is connected to a power voltage supply terminal VDD and the other side is connected to a gate thereof so as to serve as a diode, a PMOS transistor MP1 of which one side is connected to the power voltage supply terminal VDD and a gate is connected to the gate of the PMOS transistor MP2 so as to form a current mirror with the PMOS transistor MP2, an NMOS transistor MN2 receiving the reference voltage VREF through a gate thereof of which one side is connected to the other side of the PMOS transistor MP1, and an NMOS transistor MN3 receiving the detection voltage VD through a gate of which one side is connected to the other side of the PMOS transistor MN2, and an NMOS transistor MN1 receiving the reference voltage VREF through a gate thereof of which one side is commonly connected to the other sides of the NMOS transistors MN2 and MN3 and the other side is connected to a ground voltage supply terminal VSSI.

The comparison result of the comparator 10 is supplied to the internal voltage output unit 20 through a common node of the PMOS transistor MP1 and the NMOS transistor MN2.

The internal voltage output unit 20 is provided with a PMOS transistor MP3 receiving the comparison result of the comparator 10 of which one side is connected to the power voltage supply terminal VDD and the other side is connected to a node X applying the internal voltage VINT, and resistors Ra and Rb connected between the node X and the ground voltage supply terminal VSSI, connected to each other in series. The voltage applied to the common node X of the resistors Ra and Rb is the detection voltage VD, which is outputted to the gate of the NMOS transistor MN3.

Hereinafter, an operation of the conventional internal power generator will be set forth, which generates the internal voltage after receiving the reference voltage.

To begin with, when the reference voltage VREF is applied to the comparator 10, the NMOS transistor MN1 is turned on to enable the comparator 10.

Thereafter, the comparator 10 compares the voltage level of the reference voltage VREF with the voltage level of the detection voltage VD. Thus, if the voltage level of the detection voltage VD is higher than that of the reference voltage VREF, the comparator 10 outputs a comparison signal VC of logic low level to the gate of the PMOS transistor MP3 in the internal voltage output unit 20.

Accordingly, the PMOS transistor MP3 becomes turned on, which results in increasing the voltage of the node X and the voltage level of the detection voltage VD.

The detection voltage VD is inputted to the comparator 10 when the state of the voltage level is being increased so that the comparison signal VC of low level is outputted to the gate of the PMOS transistor MP3 in the internal voltage output unit 20 until the voltage level of the reference voltage VREF becomes lowered than that of the comparison signal VC.

In case that the voltage level of the reference voltage VREF inputted to the comparator 10 becomes lowered than that of the comparison signal VC, the comparison signal VC of logic high level is outputted to the gate of the PMOS transistor MP3 in the internal voltage output unit 20. Therefore, the voltage levels of the node X voltage and the detection voltage VD are not increased any more and are maintained to be uniform levels. When the node X voltage and the detection voltage are in the uniform voltage levels, the node X voltage is applied to a core circuit of the memory device as the internal voltage VINT.

If the voltage level of the internal voltage VINT is decreased during the operation of the semiconductor memory device so that the reference voltage of which the voltage level is lower than that of the detection voltage VD is inputted to the comparator 10, the comparator 10 outputs the comparison signal VD of the logic low level again to the gate of the PMOS transistor MP3 in the internal voltage output unit 20. Thus, the voltage levels of the internal voltage VINT and the detection voltage VD rise up to predetermined voltage levels again.

The reference voltage VREF applied to the comparator 10 is a signal having a fixed voltage level with respect to an electric potential level of the external power voltage, variances of fabrication processes and a temperature variance of a peripheral area in operation.

Since the internal voltage VINT is generated as described above, it is impossible to modify the internal voltage level while testing the memory device in a state of being packaged or according to a user's requirement.

That is, although the voltage level of the external power voltage VDD is increased, the internal voltage VINT generated by the internal voltage generator still keeps a predetermined voltage level so that it is impossible to change the voltage level.

Therefore, in order to change an internal process speed of the memory device in testing the device or by only the user's arbitrary requirement, it is impossible to change the internal voltage level up to now.

SUMMARY OF THE INVENTION

It is, therefore, an object of the present invention to provide a semiconductor memory device capable of controlling an internal voltage level for modifying an internal operation state of the memory device.

In accordance with an aspect of the present invention, there is provided an internal voltage generation circuit of a semiconductor memory device, including: a comparator for comparing a reference voltage level with a detection voltage level to provide a comparison signal; an internal voltage output means for raising a voltage of an internal voltage output terminal to a predetermined level in response to the comparison signal, and for outputting the detection voltage corresponding to the voltage of the internal voltage output terminal to the comparator; and an internal voltage output controller for controlling the internal voltage output terminal to be raised to a selected level corresponding to a control code among a plurality of different voltage levels of which levels are higher than the predetermined level, wherein a voltage applied to the internal voltage output terminal is outputted as an internal voltage.

BRIEF DESCRIPTION OF THE DRAWINGS

The above and other objects and features of the present invention will become better understood with respect to the following description of the specific embodiments given in conjunction with the accompanying drawings, in which:

FIG. 3 is a table setting forth a JEDEC specification of a DDR synchronous memory device;

DETAILED DESCRIPTION OF THE INVENTION

An internal voltage generator of a semiconductor device in accordance with exemplary embodiments of the present invention will be described in detail with reference to the accompanying drawings.

Figure 1:
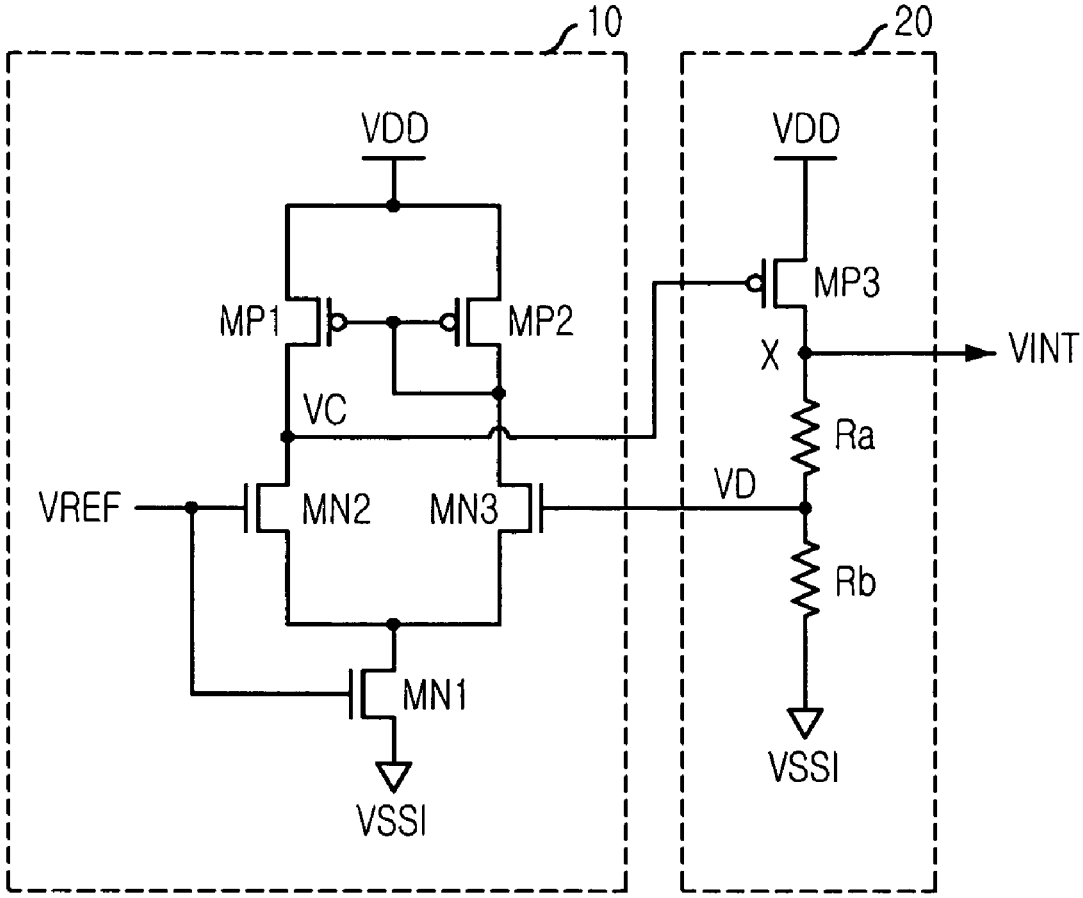
FIG. 1 (PRIOR ART)
FIG. 1 is a circuit diagram setting forth a conventional internal voltage generation circuit of a semiconductor memory device.
Figure 2:
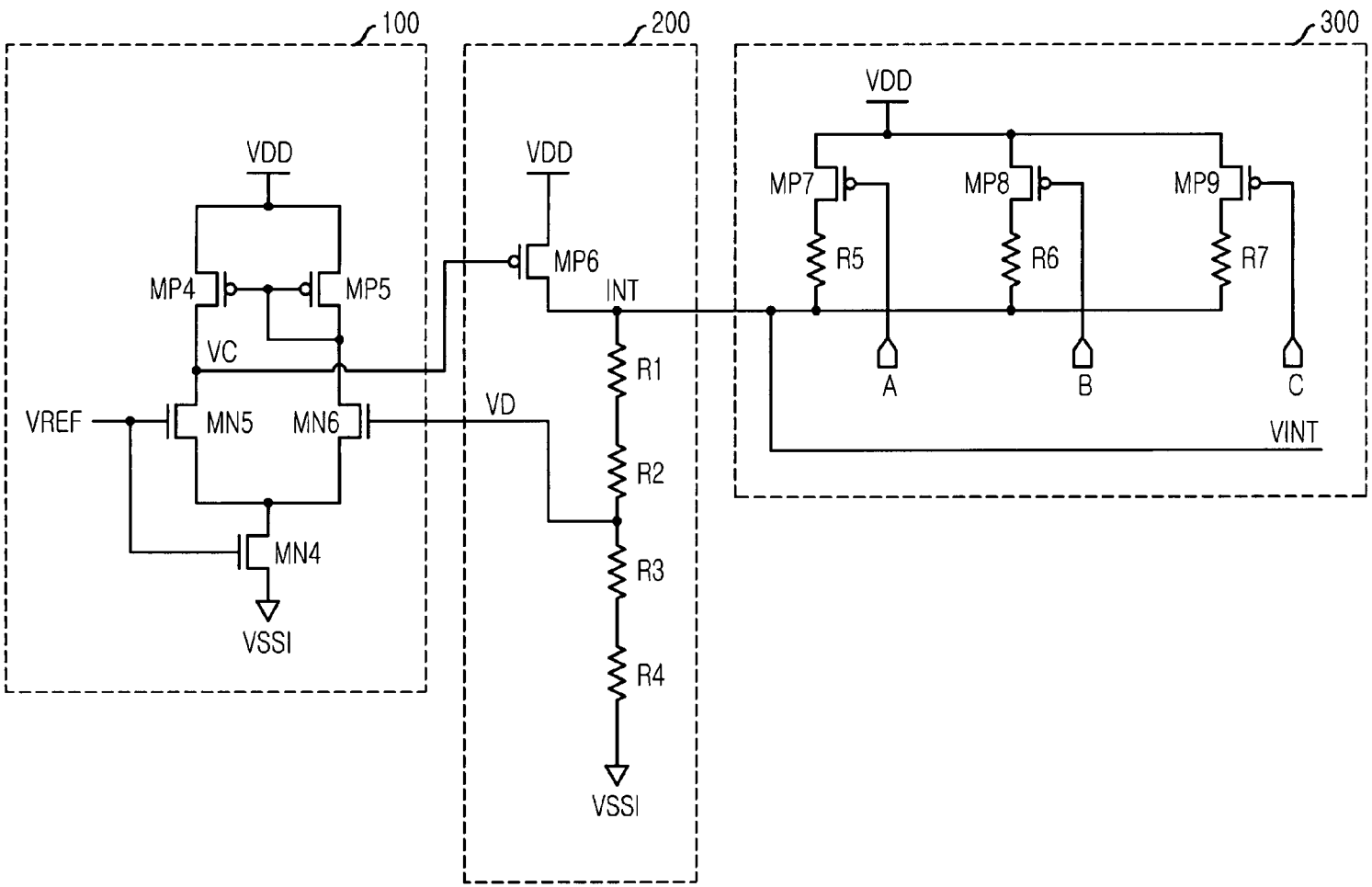
FIG. 2 is a circuit diagram setting forth an internal voltage generation circuit of a semiconductor memory device in accordance with a first embodiment of the present invention.

FIG. 2 is a circuit diagram setting forth an internal voltage generation circuit of a semiconductor memory device in accordance with a first embodiment of the present invention.

Referring to FIG. 2, the internal voltage generation circuit of the semiconductor memory device includes a comparator 100, an internal voltage output unit 200 and an internal voltage output controller 300. Herein, the comparator 100 compares a voltage level of a reference voltage VREF with a voltage level of a detection voltage VD. In addition, the internal voltage output unit 200 raises a voltage of an internal voltage output terminal INT to a predetermined voltage level in response to a comparison signal VC and applies the detection voltage VD corresponding to the voltage of the internal voltage terminal INT into the comparator 10. The internal voltage output controller 300 controls the voltage of the internal voltage output terminal INT to be raised to a selected level which is higher than the predetermined voltage level, corresponding to a control code among a plurality of different voltage levels. Therefore, the internal voltage generation circuit of the present invention outputs the voltage applied to the internal voltage output terminal INT as the internal voltage.

The internal voltage output controller 300 uses information corresponding to a CAS latency as control codes A, B and C.

The internal voltage output controller 300 is provided with a plurality of MOS transistors MP7, MP8 and MP9 and a plurality of resistors R5, R6 and R7. Herein, the plurality of the MOS transistors MP7, MP8 and MP9 connected in parallel receive the control codes A, B and C, respectively and one side is commonly connected to the power voltage supply terminal VDD. The plurality of resistors R5, R6 and R7 are connected in parallel of which a respective one side is connected to each of the other sides of the MOS transistors MP7, MP8 and MP9, respectively and the other side is commonly connected to the internal voltage output terminal int.

The internal voltage output unit 200 is provided with a PMOS transistor PM6 receiving the comparison signal VC through a gate thereof of which one side is connected to the power voltage supply terminal VDD and the other side is connected to the internal voltage output terminal INT, and a plurality of resistors R1 to R4 connected between the other side of the PMOS transistor MP6 and the ground voltage supply terminal VSSI. Herein, the plurality of resistors R1 to R4 are connected in series and the number of the resistor is at least two so that the resistors R1 to R4 divide the voltage to output the divided voltage as the detection voltage VC.

The comparator 100 is provided with a PMOS transistor MP5 of which one side is connected to a power voltage supply terminal VDD and the other side is connected to a gate thereof so as to serve as a diode, a PMOS transistor MP4 of which one side is connected to the power voltage supply terminal VDD and a gate is connected to the gate of the PMOS transistor MP5 so as to form a current mirror with the PMOS transistor MP5, an NMOS transistor MN5 receiving the reference voltage VREF through a gate thereof of which one side is connected to the other side of the PMOS transistor MP4, and an NMOS transistor MN6 receiving the detection voltage VD through a gate of which one side is connected to the other side of the PMOS transistor MN5, and an NMOS transistor MN4 receiving the reference voltage VREF through a gate of which one side is commonly connected to the other sides of the NMOS transistors MN5 and MN6 and the other side is connected to a ground voltage supply terminal VSSI.

Herein, the comparison result is applied to the internal voltage output unit 200 through the common node of the PMOS transistor MP4 and the NMOS transistor MN5, as the comparison signal VC.

FIG. 3 is a table setting forth a JEDEC specification of a DDR synchronous memory device.

An operation of the internal voltage generation circuit of the semiconductor memory device will be set forth more fully in detail with reference to FIGS. 2 and 3, as follows.

To begin with, when the reference voltage VREF is applied to the comparator 100, the NMOS transistor MN4 is turned on to enable the comparator 100.

Thereafter, the comparator 100 compares the voltage level of the reference voltage VREF with the voltage level of the detection voltage VD. Thus, if the voltage level of the detection voltage VD is higher than that of the reference voltage VREF, the comparator 100 outputs a comparison signal VC of logic low level to the gate of the PMOS transistor MP6 in the internal voltage output unit 200.

Accordingly, the PMOS transistor MP6 becomes turned on, which results in increasing the voltage of the internal voltage output terminal INT and the voltage level of the detection voltage VD.

Till the voltage level of the reference voltage VREF is lower than the voltage level of the detection voltage VD, the comparison signal VC of logic low level is outputted to the gate of the PMOS transistor MP6 in the internal voltage output unit 200. Meanwhile, the detection voltage VD is inputted into the comparator 100 in a state when the voltage level being increased.

If the voltage level of the reference voltage VREF inputted to the comparator 10 is lower than that of the detection voltage VD, the comparison signal VC of logic high level is outputted to the gate of the PMOS transistor in the internal voltage output unit 200.

Therefore, the voltage levels of the internal voltage output terminal INT and the detection voltage VD are not increased any more and are maintained to be uniform levels. When the voltage of internal voltage output terminal INT and the detection voltage VD are in the uniform voltage levels, the voltage applied to the internal voltage output terminal is provided to a core circuit of the memory device as the internal voltage VINT.

If the voltage level of the internal voltage VINT is decreased during the operation of the semiconductor memory device so that the reference voltage VREF of which the voltage level is lower than that of the detection voltage VD is inputted to the comparator 100, the comparator 100 outputs the comparison signal VC of the logic low level again to the gate of the PMOS transistor MP6 in the internal voltage output unit 200. Thus, the voltage levels of the internal voltage VINT and the detection voltage VD rise up to predetermined voltage levels again.

The reference voltage VREF applied to the comparator 100 is a signal having a uniform voltage level with respect to an electric potential level of the external power voltage, variances of fabrication processes and a temperature variance of a peripheral area in operation.

If there is a need for controlling the voltage level of the internal voltage VINT outputted from the internal voltage generation circuit, desired information is inputted through control codes A, B and C to the internal voltage output controller 300.

In general operation mode, logic levels of the control codes A, B and C are maintained to be high levels so that all the PMOS transistors MP7, MP8 and MP9 are turned off.

In case of controlling the voltage level of the internal voltage VINT, the control codes A, B and C are changed. That is, when the control signals A, B and C are inputted in low level, high level and high level, respectively, the PMOS transistor MP7 is turned on so that the voltage level of the internal voltage output terminal INT becomes increased to a predetermined voltage level.

In addition, provided that the control signals A, B and C are inputted in low level, low level and high level, respectively, all the PMOS transistors MP7, MP8 and MP9 are turned on so that the voltage level of the internal voltage output terminal INT is raised to the highest level that the internal voltage output controller 300 of FIG. 2 can have.

Like the above, the voltage level of the internal voltage output terminal INT can be increased through the internal voltage output controller 300 so that it is possible to control the internal voltage VINT to have various voltage levels in testing the device or according to a user's requirement.

When the voltage level of the internal voltage is controlled, the operational speed of the memory device is able to be arbitrarily modified so that it is possible to be applied in various ways.

Herein, for the control codes A, B and C, a method for inputting the information with regard to the CAS latency is used.

That is, the case that a column select bar signal/CS, a row address strobe bar signal/RAS, a column address strobe bar signal/CAS and a write enable bar signal/WE are in low levels, are utilized. In other words, predetermined signals, i.e., the information for the CAS latency inputted through address pins A4, A5 and A6 in a state of a mode register set (MRS) command are used as the control signals inputted to the internal voltage output controller 300.

For reference, in an MRS command of 512 M DDR synchronous memory device, address pins A0 to A2, an address pin A3, address pins A4 to A7, and address pins A7 to A12 receive predetermined sets such as a burst length, a burst type, the CAS latency and an operation mode, respectively. FIG. 3 is a table illustrating information regarding the MRS command of the 512 M DDR synchronous memory device.

Figure 4:
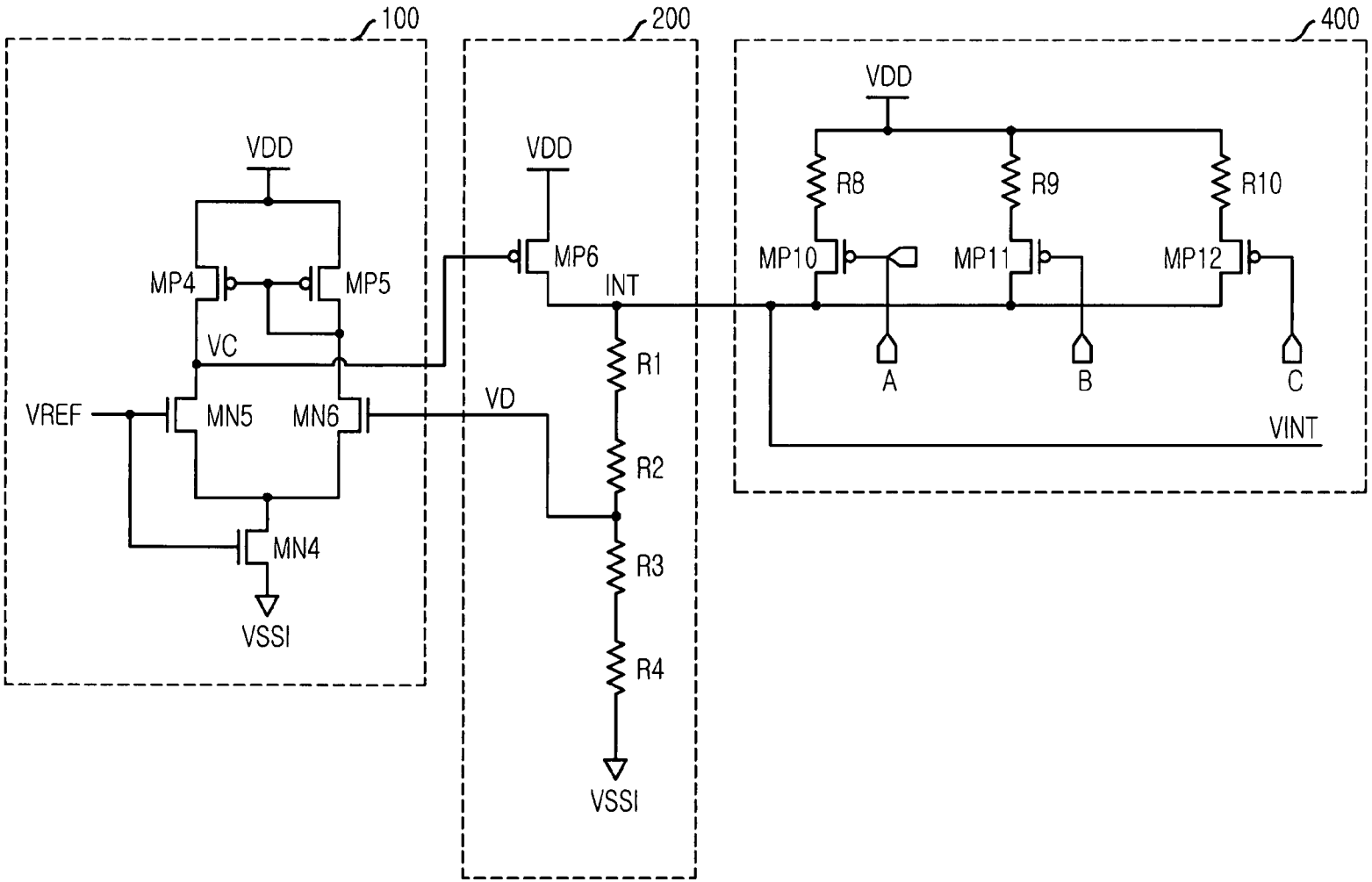
FIG. 4 is a circuit diagram setting forth an internal voltage generation circuit of a semiconductor memory device in accordance with a second embodiment of the present invention.

FIG. 4 is a circuit diagram setting forth an internal voltage generation circuit of a semiconductor memory device in accordance with a second embodiment of the present invention.

Referring to FIG. 4, the internal voltage generation circuit of the second embodiment has the same constitution with that of the first embodiment except that position between each resistor and each MOS transistor is modified in an internal voltage output controller 400.

The internal voltage output controller 300 is provided with a plurality of resistors R8 to R10 connected in parallel of which one sides are commonly connected to the power voltage terminal VDD, and a plurality of PMOS transistors MP10 to MP12 receiving corresponding control signals A, B and C through gate thereof of which one side is connected to the other sides of the resistors R8 to R10 respectively and the other sides are commonly connected to the internal voltage output terminal INT.

As similar to the first embodiment, the information inputted corresponding to the CAS latency is used. Since the whole operation is the same with that of the first embodiment, further detail descriptions will be omitted herein.

Figure 5:
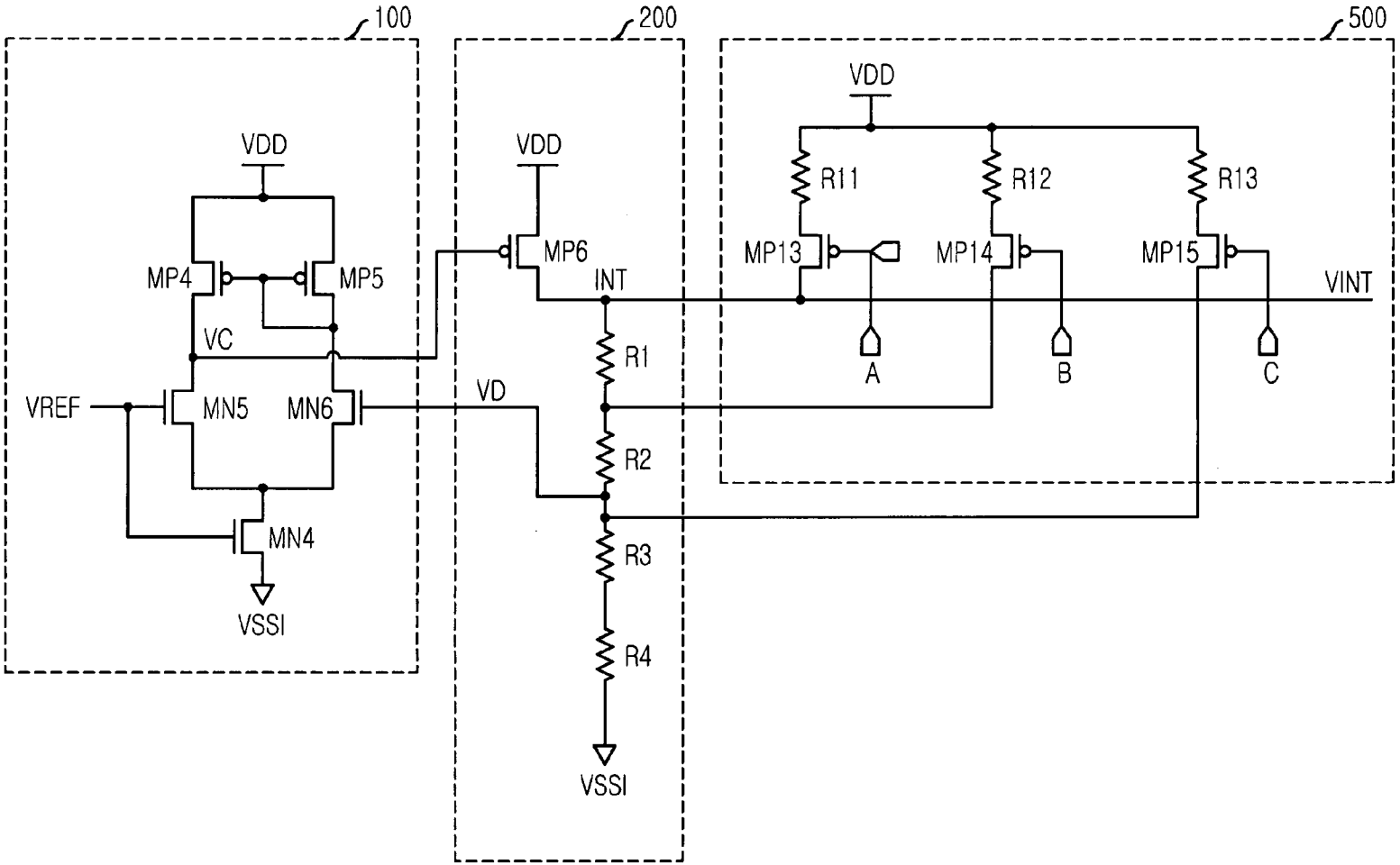
FIG. 5 is a circuit diagram setting forth an internal voltage generation circuit of a semiconductor memory device in accordance with a third embodiment of the present invention.

FIG. 5 is a circuit diagram setting forth an internal voltage generation circuit of a semiconductor memory device in accordance with a third embodiment of the present invention.

The internal voltage generation circuit of the semiconductor memory device in accordance with the third embodiment has the same constitution with that of the second embodiment. However, a method for increasing the voltage of the internal voltage output terminal INT in the internal voltage output controller 500 is different from that of the second embodiment.

That is, the plurality of resistors R11 to R13 connected in parallel contained in the internal voltage output controller 300 are not commonly connected to the internal voltage output terminal INT but they are connected to each of one side of the plurality of the resistors R11 to R14, respectively.

The internal voltage output controller 500 is provided with a plurality of resistors R11 to R13, and a plurality of MOS transistors MP13 to MP 15. Herein, one side of each resistor R11 to R13 is commonly connected to the power supply voltage terminal VDD and the other side is connected to one side of each PMOS transistor MP13 to MP 15. The other side of the PMOS transistor PMOS MP13 is connected to the internal voltage output terminal INT and receives the control code A through a gate thereof. Likewise, the other side of the PMOS transistor PMOS MP14 is connected to the other side of the resistor R1 in the internal voltage output unit 200 and receives the control code B through a gate thereof. The other side of the PMOS transistor PMOS MP15 is connected to the other side of the resistor R2 in the internal voltage output unit 200 and receives the control code C through a gate thereof.

As similar to the first and the second embodiments, the control codes A, B and C use the information inputted corresponding to the CAS latency.

In accordance with the present invention, the voltage level of the internal voltage is controlled by using the information such as the CAS latency used in the MRS operation so that it is possible to control the operational speed of the memory device in testing the device or according to the user's requirement.

Therefore, the semiconductor memory device can be operated in various voltage levels in a packaged state so that the present invention is very effective for developing and researching the memory device. As a result, the user can apply the inventive internal voltage generation circuit for various systems.

The present application contains subject matter related to Korean patent application No. 2005-0058714, filed in the Korean Intellectual Property Office on Jun. 30, 2005, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. An internal voltage generation circuit of a semiconductor memory device, comprising:

a comparator for comparing a reference voltage level with a detection voltage level to provide a comparison signal;

an internal voltage output means for outputting a detection voltage and an internal voltage respectively to a predetermined level in response to the comparison signal; and an internal voltage output controller for controlling the internal voltage to be raised to a selected level among a plurality of different voltage levels that are higher than the predetermined level, by using a control code having information.

2. The internal voltage generation circuit of claim 1, wherein the internal voltage output means operates to output the detection voltage corresponding to the internal voltage to the comparator.

3. The internal voltage generation circuit of claim 1, wherein the information corresponds to a CAS latency.

4. The internal voltage generation circuit of claim 1, wherein the internal voltage output controller includes:

a plurality of MOS transistors connected in parallel of which one sides are commonly connected to a power voltage supply terminal, each of the plurality of the MOS transistors receiving the corresponding control code through a gate thereof; and a plurality of first resistors of which each of one sides is connected to the other side of the respective MOS transistor and each of the other sides is commonly connected to the internal voltage output terminal.

5. The internal voltage generation circuit of claim 1, wherein the internal voltage output controller includes:

a plurality of first resistors of which one sides are commonly connected to the power voltage supply terminal; and a plurality of MOS transistors connected in parallel, of which each of one sides is connected to the other side of a corresponding resistor among the plurality of the resistors and the other sides are commonly connected to the internal voltage output terminal, each of the plurality of the MOS transistors receiving a corresponding control code respectively.

6. The internal voltage generation circuit of claim 5, wherein the information which is inputted corresponds to a CAS latency.

7. The internal voltage generation circuit of claim 5, wherein the internal voltage output means includes:

a first PMOS transistor receiving the comparison signal through a gate thereof, of which one side is connected to the power voltage supply terminal and the other side is connected to the internal voltage output terminal; and a second resistor in which at least two resistors are connected in series, a second resistor being connected between the other side of the first PMOS transistor and the ground voltage supply terminal, wherein a voltage divided by the second resistor is applied as the detection voltage.

8. The internal voltage generation circuit of claim 7, wherein the comparator includes:

a diode-connected PMOS transistor of which one side is connected to the power voltage supply terminal;

a second PMOS transistor forming a current mirror with the diode-connected transistor, of which one side is connected to the power voltage supply terminal and a gate is connected to the gate of the diode-connected transistor;

a first NMOS transistor receiving the reference voltage through a gate thereof, of which one side is connected to the other side of the second PMOS transistor;

a second NMOS transistor receiving the detection voltage through a gate thereof, of which one side is connected to the other side of the diode-connected PMOS transistor; and a third NMOS transistor receiving the reference voltage through a gate thereof, of which one side is connected to the other side of the first and the second NMOS transistors and the other side is connected to the ground voltage supply terminal, wherein the comparison signal is supplied through the common node of the second PMOS transistor and the first NMOS transistor.

9. The internal voltage generation circuit of claim 1, wherein the internal voltage output means includes:

a first MOS transistor receiving the comparison result through a gate thereof, of which one side is connected to the power voltage supply terminal and the other side is connected to the internal voltage output terminal; and a first resistor in which at least two resistors are connected in series, connected between the other side of the first MOS transistor and the ground voltage supply terminal, wherein the voltage divided by the first resistor is applied as the detection voltage.

10. The internal voltage generation circuit of claim 9, wherein the internal voltage output controller includes:

a plurality of second resistors connected in parallel, of which each of the other sides is connected to one side of a corresponding resistor among a plurality of first resistors, the plurality of the first resistors connected in parallel being allocated at the internal voltage output terminal; and a plurality of second MOS transistors connected in parallel, of which one sides are commonly connected to the power voltage supply terminal and each of the other sides are connected to one side of a corresponding resistor among the plurality of the second resistors.

11. The internal voltage generation circuit of claim 10, wherein the information which is inputted corresponds to a CAS latency.

* * * * *